United States Patent [19]

Patel

[11] Patent Number: 4,927,787

[45] Date of Patent: May 22, 1990

[54] UNITARILY MOLDED ELECTRICAL CONNECTOR HOUSING WITH SEPARABLE KEY

[75] Inventor: Arvind Patel, Naperville, Ill.

[73] Assignee: Molex Incorporated, Del.

[21] Appl. No.: 308,299

[22] Filed: Feb. 9, 1989

[51] Int. Cl.[5] ..... H01R 29/00

[52] U.S. Cl. ..... 439/189; 200/506; 439/148

[58] Field of Search ..... 439/189, 159, 160, 269, 439/577, 923, 475, 148; 200/506, 508, 51.09–51.11

[56] References Cited

U.S. PATENT DOCUMENTS 3,873,174 3/1975 Horecky et al. ..... 339/95 D
4,286,121 8/1981 Olszewski et al. ..... 200/506
4,426,121 1/1984 Stoewe et al. ..... 439/148
4,636,603 1/1987 Pliml ..... 200/506

*Primary Examiner*—P. Austin Bradley
*Attorney, Agent, or Firm*—Louis A. Hecht; Stephen Z. Weiss

[57] ABSTRACT

A nonconductive electrical connector housing is integrally molded with a nonconductive key. The housing is constructed to receive at least one pair of switch terminals therein such that contact portions of the switch terminals can be in electrical contact with one another. The key is selectively separable from the housing and can be urged into a position to move the contact portions of the switch terminals relative to one another to thereby open or close the circuit of which the switch terminals are a part.

4 Claims, 4 Drawing Sheets

UNITARILY MOLDED ELECTRICAL CONNECTOR HOUSING WITH SEPARABLE KEY

BACKGROUND OF THE INVENTION

Electrical connectors typically comprise a nonconductive housing having at least one electrically conductive terminal securely mounted therein. The terminal is electrically mounted therein. The terminal lead, such as a conductor in a wire or cable. The electrical connector typically will be constructed to mate with another connector having at least one appropriately configured terminal mounted therein, such that upon complete mating of the electrical connectors, the terminals of the respective connectors will achieve electrical contact with one another. The configuration of electrical connector housings or terminals varies widely depending upon the required end use for the connector. However, an objective of virtually all connectors is to provide a housing formed from a substantially minimum number of components.

Certain electrical connectors may have portions which may be required to function as switches. In particular, a connector housing may comprise a pair of electrically conductive terminals mounted therein to be selectively placed in electrical contact with one another. Thus, the electrical contact achieved between the two terminals in a single electrical connector housing will complete a circuit between the conductive leads to which the respective terminals are connected. Prior art electrical connectors which function as switches include a plurality of separately formed components that can be moved relative to one another to urge a pair of terminals selectively into or out of electrical contact. The plural separately formed movable components required for the prior art electrical connectors of this type have added to the cost of the electrical connectors and have created inventory control problems.

Accordingly, it is an object of the subject invention to provide an electrical connector that can efficiently function as a switch to selectively make or break circuits between leads terminated therein.

It is another object of the subject invention to provide an electrical connector switch formed from a minimum number of components.

A further object of the subject invention is to provide an electrical connector switch that has the nonconductive components unitarily molded.

An additional object of the subject invention is to provide an electrical connector switch having a unitarily molded housing with at least one separable portion that enables selective separation or contact between terminals mounted in the housing.

Still another object of the subject invention is to provide an electrical connector having at least one portion which functions as a switch and at least one additional portion that can be mated with a second electrical connector.

SUMMARY OF THE INVENTION

The subject invention is directed to an electrical connector switch having a nonconductive housing that may be unitarily molded from a plastic material. The housing comprises at least one terminal receiving cavity therein. In particular, the housing may comprise opposed forward and rearward ends, with each cavity extending therebetween such that terminals may be lockingly insertable from the rearward end of the housing.

The housing is constructed such that at least two terminals receivable therein can be selectively placed in electrical contact with one another to define switch terminals. In particular, the housing may receive a pair of switch terminals, at least one of which will comprise a deflectable contact portion which may be biased against the other switch terminal in the pair. The electrical contact between the two terminals in each pair of switch terminals will complete a circuit between the leads to which the respective switch terminals in the pair are electrically and mechanically connected. The connector housing may comprise at least one additional cavity for receiving an electrically conductive terminal that may be mated with a terminal of another electrical connector.

The electrical connector housing further comprises a nonconductive key which is integrally or unitarily molded with at least a portion of the housing. The key is selectively separable from the remainder of the housing. In particular, the key may be joined to the remainder of the housing by a frangible tab or other such connecting portion which readily can be broken to separate the key from the remainder of the housing. The key is dimensioned and configured to be selectively urged into contact with at least one terminal in the pair of switch terminals mounted in the housing. In this manner the key will be operable to either complete or break the contact between the switch terminals. In particular, the key may comprise an elongated blade portion which is slidably insertable between the contact portions of the pair of switch terminals to break the electrical connection between the switch terminals. The key may further comprise an appropriately dimensioned and configured base which readily can be manipulated by a technician assembling or using the subject electrical connector. The key may comprise a portion which is engageable with a corresponding key aperture in the electrical connector housing and/or a corresponding aperture in a circuit board to which the subject electrical switch connector is mounted. Thus, forces between the key and the connector housing or between the key and the circuit board to which the connector is mounted may help to prevent accidental removal of the key from the switch terminal cavity and/or over insertion of the key into the switch terminal cavity.

The initial integral construction of the key and the housing results in very substantial savings in cost and eliminates inventory control problems. In particular, a functionally comparable assembly of structures with separately molded keys would require a plurality of the keys to be molded on a carrier strip, with the carrier strip representing a very significant portion of the total material requirements for the key. The integral construction of the key to remaining portions of the housing avoids this waste of material while simultaneously avoiding inventory control problems. The connection of the housing and the key at the base of the key ensures that the blade of the key will not be affected by a possible uneven break of the key from the housing. Thus, the blade of the key will efficiently and reliably function to urge the terminals either apart or together.

DETAILED DESCRIPTION OF THE PREFERRED EMBODIMENT

Figure 1:
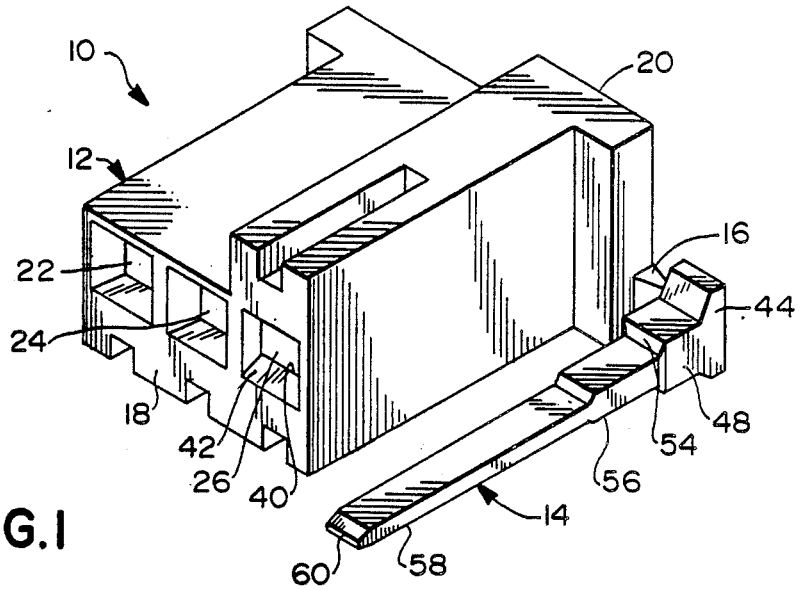
FIG. 1 is a perspective view of the unitarily molded electrical connector housing and key.
Figure 3:
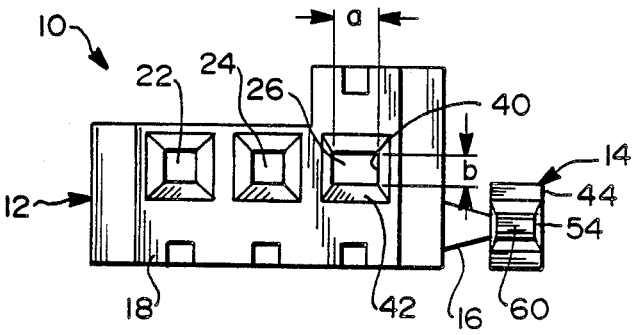
FIG. 3 is a front elevational view of the unitarily molded housing and key.
Figure 2:
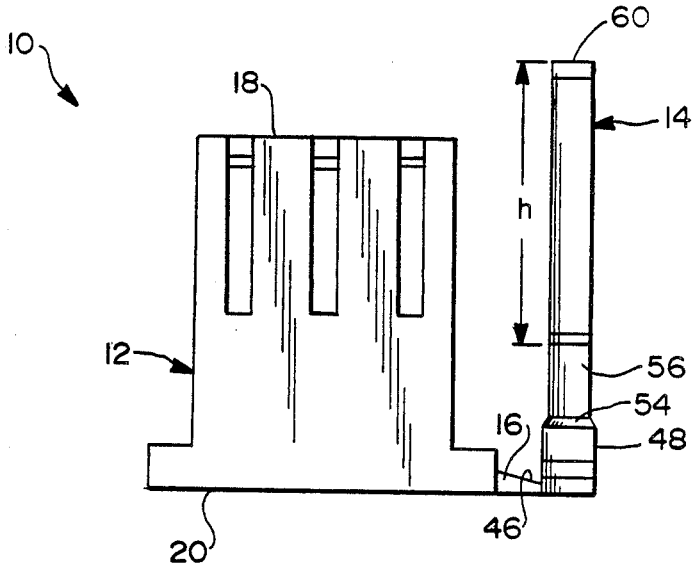
FIG. 2 is a bottom elevational view of the unitarily molded housing and key.
Figure 4:
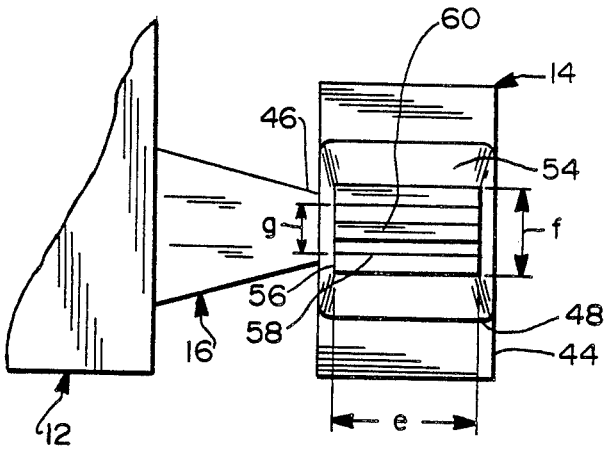
FIG. 4 is a front elevational view showing in detail the frangible tab between the unitarily molded electrical connector housing and key.
Figure 6:
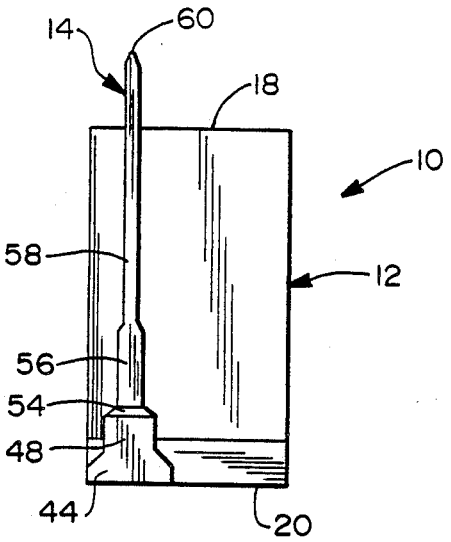
FIG. 6 is a side elevational view of the unitarily molded housing and key.
Figure 5:
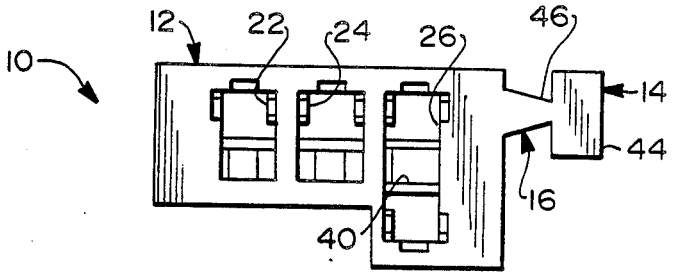
FIG. 5 is a rear elevational view of the unitarily molded housing and key.

A unitarily molded electrical connector housing and key structure in accordance with the subject invention is indicated generally by the numeral 10 in FIGS. 1–6, and comprises a housing 12, a key 14 and a frangible tab 16 unitarily extending therebetween.

The housing 12 includes a forward mating end 18 and an opposed rearward end 20. A pair of terminal receiving cavities 22 and 24 and a switch terminal receiving cavity 26 extend generally parallel to one another between the forward and rearward ends 18 and 20 of the housing 12. The terminal receiving cavities 22 and 24 each are constructed to receive an electrical terminal (not shown). Thus, a second electrical connector (not shown) can be mated with the connector housing 12 such that the respective terminals in the mated connectors electrically contact one another.

Figure 8:
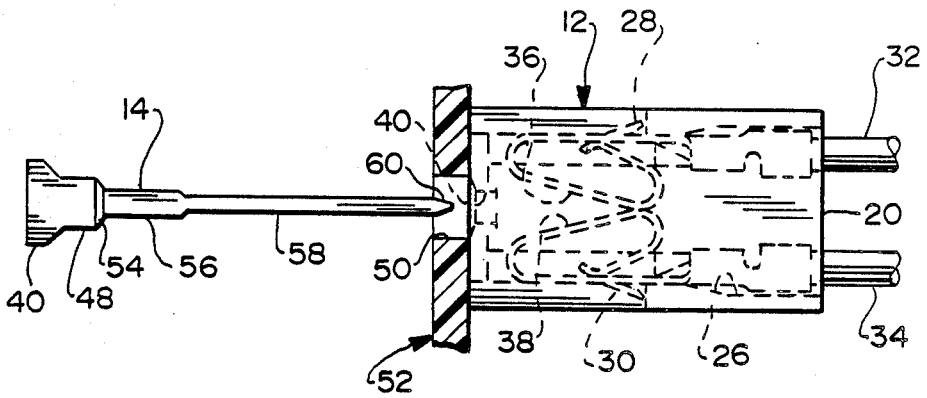
FIG. 8 is a cross-sectional view showing the electrical connector switch with the key being inserted therein.
Figure 9:
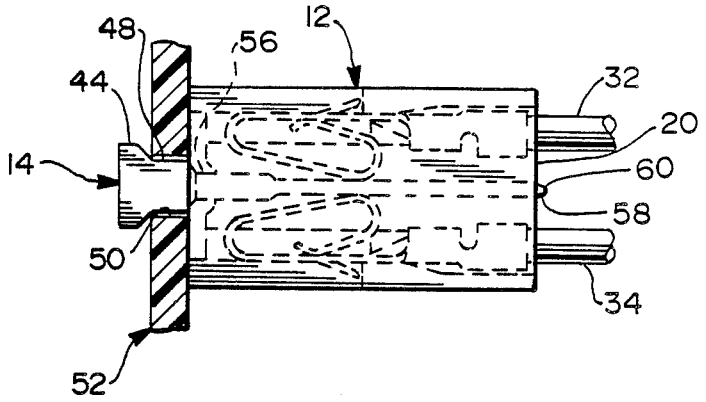
FIG. 9 is a cross-sectional view similar to FIG. 8 but showing the key in its fully seated position for separating the contact portions of the terminals therein.

As shown most clearly in FIGS. 8 and 9, the switch terminal receiving cavity 26 is constructed to receive a pair of electrical terminals 28 and 30 therein. The terminals 28 and 30 are electrically and mechanically connected to insulated conductive leads 32 and 34 which extend from the rearward end 20 of the housing 12. The terminals 28 and 30 comprise deflectable contact beams 36 and 38 respectively. The contact beams 36 and 38 are dimensioned to be deflected by one another and to exert a selected electrical contact force against one another. Thus, the contact beams 36 and 38 complete a circuit between the respective leads 32 and 34.

It is to be understood that the embodiment of the invention illustrated in FIGS. 1–9 is but one possible embodiment. In particular, the electrical connector housing 12 does not require the terminal receiving cavities 22 and 24, and may be provided with more than one switch terminal receiving cavity 26. Alternatively, the housing 12 may be provided with more than the illustrated two terminal receiving cavities 22 and 24.

The switch terminal receiving cavity 26 is characterized by a key receiving aperture 40 at the forward end 18 of the housing 12. The key receiving aperture is generally rectangular with a width "a" of approximately 0.085 inch and a height "b" of approximately 0.055 inch. The key receiving aperture 40 includes a tapered entry 42 to facilitate the insertion of the key 14 therein as explained further below. The key receiving aperture 40 at the forward end 18 of the housing 12 is disposed to be generally in line with the abutting contact beams 36 and 38 of the respective terminals 28 and 30.

The key 14 includes a base 44 which is unitarily connected to the rearward end 20 of the housing 12 by the frangible connecting tab 16. As shown most clearly in FIG. 4, the connecting tab 16 includes a reduced dimension frangible portion 46 adjacent the base 44 of the key 16 which can readily be broken by merely twisting the key 14 relative to the housing 12. The base 44 of the key 14 is dimensioned to facilitate convenient manipulation by a technician working with the unitarily molded structure 10, and preferably defines a width "c" of approximately 0.090 inch and a height "d" of approximately 0.150 inch.

The key 14 tapers to define a board engaging portion 48 having a height "c" which is approximately equal to the width "c" of the base 44 of the key 14. The diagonal dimension defined by this board engaging portion 48 of the base 44 preferably corresponds to the diameter of the aperture 50 in a printed circuit board 52 to which the housing 12 is mounted as shown in FIGS. 8 and 9. Thus, the board engaging portion 48 of the base 44 may be frictionally retained in the aperture 50 of the circuit board 52. The key 14 further tapers to define a pyramidal portion 54 generally conforming to the shape of the tapered entry 42 to the key receiving aperture 40 of the housing 12. The pyramidal portion 54 leads to a housing engaging portion 56 of generally rectangular cross section of width "e" and height "f" slightly less than the width "a" and height "b" of the key receiving aperture 40 in the housing 12. The remainder of the key 14 defines a blade 58 which defines a height "g" of approximately 0.025 inch which is considerably less than the height "b" of the key receiving aperture 40 which, as noted above, is approximately 0.055 inch. The length "h" of the blade 58 is selected to ensure that the key 14 will extend beyond the contact beams 36 and 38 of the terminals 28 and 30 engaged in the switch terminal cavity 26 of the housing 12 as shown in FIG. 9.

Figure 7:
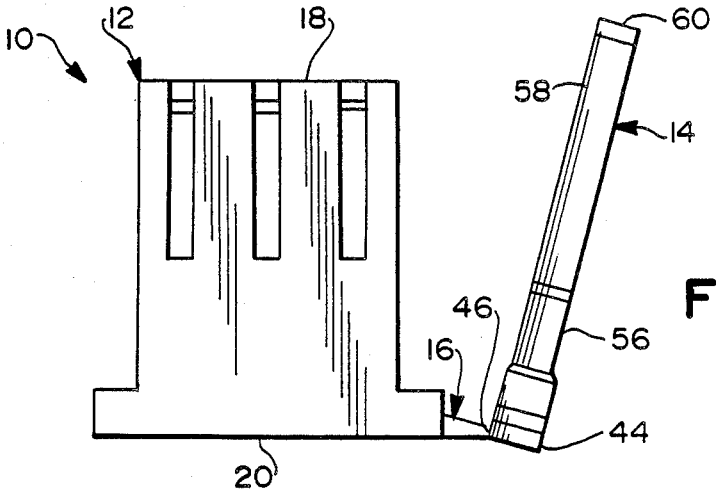
FIG. 7 is a bottom elevational view similar to FIG. 2 but showing the key being separated from the housing.

The unitary structure 10 is employed by initially twisting the key 14 relative to the housing 12 to break the frangible tab 44 therebetween as shown in FIG. 7. The end 60 of the key 14 then is slidably inserted into the key receiving aperture 40 of the housing as shown in FIG. 8. Sufficient insertion of the key 14, as shown in FIG. 9, will place the blade 58 of the key 14 intermediate the contact beams 36 and 38 of the terminals 28 and 30, thereby breaking the circuit between the leads 32 and 34. The key 14 will be retained in the position shown in FIG. 9 by the contact forces of the terminals 28 and 30 against the blade 58 and to a lesser extent by frictional engagement between the housing engaging portion 56 of the key 14 with the key receiving aperture 40 in the housing 12. Additionally, as shown in both FIGS. 8 and 9, the housing 12 may be mounted with the forward end 18 thereof abutting a circuit board 48. Thus, the board engaging portion 48 of the key 14 may be frictionally retained relative to the aperture 50 in the circuit board 52.

The switch may be operated by pulling the key 14 and/or the housing 12 in opposite directions. Thus, the key 14 and the housing 12 will be returned from the FIG. 9 orientation back into the FIG. 8 orientation to complete the circuit between the leads 32 and 34. This withdrawal of the key 14 from the housing 12 can be completed manually. However, in certain applications, the separation of the key 14 and housing 12 will be condition responsive. Thus, a certain operating condition of the apparatus in which the housing 12 is employed, will cause relative movement between the housing 12 and the key 14. For example, the housing 12 may be urged away from the circuit board 52 in response to a selected condition, while the key 14 will be prevented from such movement by the enlarged portion of the base 44 thereof engaging the board 52.

In summary, a unitarily molded housing and key are provided. The housing is molded to define at least one cavity for receiving a pair of switch terminals therein, such that contact portions of the terminals are in electrical contact with one another to complete a circuit between the leads to which the switch terminals are mounted. The key is selectively separable from the housing by twisting the key and housing relative to one another to break a frangible tab or other such connection unitarily molded therebetween. The key can be inserted into the switch terminal receiving cavity to separate the contact portions of the switch terminals therein, thereby breaking the circuit between the leads to which the switch terminals are connected. The housing in which the switch terminals are securely mounted and the key may further be moved relative to one another to achieve separation and to thereby enable the contact portions of the switch terminals to be urged into contact with one another thereby completing the circuit.

While the invention has been described with respect to a preferred embodiment, it is apparent that various changes can be made without departing from the scope of the invention as defined by the appended claims. In particular, the housing may be molded without the terminal cavities for receiving terminals that will mate with the terminals in another housing. Additionally, the housing may be constructed to receive a plurality of pairs of switch terminals therein, with a corresponding plurality of keys unitarily molded therewith. Additionally, the particular frangible connection between the key and the housing may take forms other than the one form illustrated herein.

I claim:

1. A molded switch connector housing and key structure comprising:

an electrical connector housing having at least one switch terminal cavity for receiving a pair of electrically conductive switch terminals therein, said electrical connector housing comprising at least one key aperture extending therethrough and into the switch terminal cavity; and a key integrally molded with said electrical connector housing and selectively separable therefrom, said key comprising a blade dimensioned to pass through the key aperture of the housing for selective insertion into and removal from the switch terminal cavity thereof, the blade of said key being dimension ed to move at least one of the switch terminals relative to the other upon insertion of said key into the switch terminal cavity, whereby the separation of said key from said housing enables the key to selectively separate or permit contact between the switch terminals in said housing.

2. A molded structure as in claim 1 wherein the tab comprises a reduced dimension frangible portion intermediate the base of said key and said electrical connector housing.

3. A molded switch connector housing and key structure comprising:

an electrical connector housing having at least one switch terminal cavity for receiving a pair of electrically conductive switch terminals therein, said electrical connector housing comprising at least one key aperture extending therethrough and into the switch terminal cavity; and a key integrally molded with said electrical connector housing and selectively separable therefrom, said key comprising a base defining the portion of said key unitarily molded to said electrical connector housing and a blade dimensioned to pass through the key aperture of the housing for selective insertion into and removal from the switch terminal cavity thereof, the blade of said key being dimensioned to move at least one of the switch terminals relative to the other upon insertion of said key into the switch terminal cavity, whereby the separation of said key from said housing enables the key to selectively separate or permit contact between the switch terminals in said housing.

4. An electrical connector switch as in claim 3 further comprising a frangible tab unitarily molded with said electrical connector housing and said key, said frangible tab extending between said electrical connector housing and the base of said key.

* * * * *